US010065664B1

(12) United States Patent
Hausmann et al.

(10) Patent No.: US 10,065,664 B1
(45) Date of Patent: Sep. 4, 2018

(54) SYSTEM AND METHOD FOR INDEXING VEHICLES OF A VEHICLE SYSTEM

(71) Applicant: General Electric Company, Schenectady, NY (US)

(72) Inventors: Adam Charles Hausmann, Melbourne, FL (US); Derek Kevin Woo, Melbourne, FL (US); Peter Idema, Vancouver (CA)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/448,850

(22) Filed: Mar. 3, 2017

(51) Int. Cl.

| | |
|---|---|
| ***B61L 3/12*** | (2006.01) |
| ***B61J 3/08*** | (2006.01) |
| ***B61L 15/00*** | (2006.01) |
| ***B61J 3/12*** | (2006.01) |
| ***B61L 27/00*** | (2006.01) |

(52) U.S. Cl.
CPC ..... *B61L 3/127* (2013.01); *B61J 3/08* (2013.01); *B61J 3/12* (2013.01); *B61L 15/0027* (2013.01); *B61L 27/0083* (2013.01)

(58) Field of Classification Search
CPC .. B61L 3/127; B61L 27/0083; B61L 15/0027; B61J 3/08; B61J 3/12
See application file for complete search history.

(56) References Cited

U.S. PATENT DOCUMENTS

| | | | | |
|---|---|---|---|---|
| 4,006,691 | A | 2/1977 | Kacir et al. | |
| 6,837,168 | B1 * | 1/2005 | Goldbeck | B61J 3/06 104/162 |
| 8,942,869 | B2 | 1/2015 | Woo et al. | |
| 2007/0173990 | A1 * | 7/2007 | Smith | B61C 15/14 701/20 |
| 2015/0134147 | A1 | 5/2015 | Woo et al. | |

* cited by examiner

*Primary Examiner* — Michael J Zanelli
(74) *Attorney, Agent, or Firm* — GE Global Patent Operation; John A. Kramer

(57) ABSTRACT

A control system having a controller is configured to operate a vehicle indexing system that moves one or more vehicles in a vehicle system into a position to one or more of unload cargo off of the one or more vehicles or load the cargo onto the one or more vehicles. The controller is configured to determine a power setting of the vehicle indexing system that is used by the vehicle indexing system to move the one or more vehicles in the vehicle system into the position. The controller also is configured to determine a vehicle power setting for the vehicle system based on the power setting of the vehicle indexing system for controlling the vehicle system to provide additional tractive effort to the vehicle indexing system to move the one or more vehicles into the position.

21 Claims, 8 Drawing Sheets

SYSTEM AND METHOD FOR INDEXING VEHICLES OF A VEHICLE SYSTEM

TECHNICAL FIELD

Embodiments of the subject matter described herein relate to indexing vehicles of a vehicle system to one or more positions in order to load and/or unload cargo from one or more of the vehicles.

BACKGROUND

Vehicle systems, such as automobiles, mining equipment, rail vehicles, over-the-road truck fleets, and the like, carry cargo. The cargo of the vehicle systems may be loaded and/or unloaded by indexing vehicles of the vehicle system into an indexing position by using a vehicle indexing system. The vehicle indexing system may comprise equipment to push and/or pull the vehicles of the vehicle system into the indexing position. The indexing position is a position at which the cargo is loaded into and/or unloaded from the vehicles of the vehicle system. The vehicle indexing system can position the vehicles of the vehicle system in the indexing position with a high level of accuracy so to maximize the amount of cargo loaded and/or unloaded.

The vehicle indexing system, however, may be limited by the amount of force the vehicle indexing system is able to provide to move the vehicles of the vehicle system. As a result, vehicle systems are broken into two or more systems before the vehicle indexing system can index the vehicles to load and/or unload cargo, or very large, expensive, and powerful indexing systems are established. Separating the vehicle system into two or more vehicle systems is time consuming and may lead to increasing operating costs, decreasing operating revenue, and/or decreasing productivity of the customer. Modifications may be made to the indexing arm of the vehicle indexing system to improve the amount of force that the vehicle indexing system is able to provide. However, modifications to the indexing arm of the vehicle indexing system can be significant, costly, and time consuming.

BRIEF DESCRIPTION

In one embodiment, a control system is provided that includes a controller configured to operate a vehicle indexing system that moves one or more vehicles in a vehicle system into a position to one or more of unload cargo off of the one or more vehicles or load the cargo onto the one or more vehicles. The controller is configured to determine a power setting of the vehicle indexing system that is used by the vehicle indexing system to move the one or more vehicles in the vehicle system into the position. The controller also is configured to determine a vehicle power setting for the vehicle system based on the power setting of the vehicle indexing system for controlling the vehicle system to provide additional tractive effort to the vehicle indexing system to move the one or more vehicles into the position.

In one embodiment of the subject matter described herein, a method comprises determining a power setting of the vehicle indexing system that is used to move one or more vehicles in a vehicle system into a position to one or more of unload cargo off of the one or more vehicles or load the cargo onto the one or more vehicles. And determining a vehicle power setting for the vehicle system based on the power setting of the vehicle indexing system for controlling the vehicle system to provide additional tractive effort to move the one or more vehicles into the position to one or more of unload cargo off of the one or more vehicles or load the cargo onto the one or more vehicles.

In one embodiment, a control system includes a controller configured to operate a vehicle indexing system that moves one or more vehicles in a vehicle system into a position to one or more of unload cargo off of the one or more vehicles or load the cargo onto the one or more vehicles. The controller is also configured to determine a power setting of the vehicle indexing system that is used by the vehicle indexing system to move the one or more vehicles in the vehicle system into the position. The controller also is configured to determine a vehicle power setting for the vehicle system based on the power setting of the vehicle indexing system for controlling the vehicle system to provide additional tractive effort to the vehicle indexing system to move the one or more vehicles into the position. The controller also is configured to determine a fault state of one or more of a braking system or a route traveled by the vehicle system based on the tractive effort.

BRIEF DESCRIPTION OF THE DRAWINGS

The subject matter described herein may be understood from reading the following description of non-limiting embodiments, with reference to the attached drawings, wherein.

DETAILED DESCRIPTION

One or more embodiments of the inventive subject matter described herein relate to systems and methods that enable a vehicle system to work with a vehicle indexing system in order for the vehicle system to provide additional tractive effort to aid, augment, supplement, and/or supplant the force provided by the vehicle indexing system to move the vehicle system between indexing positions when vehicles of the vehicle system are being indexed. The systems and methods determine the tractive efforts or propulsive forces to be provided by the vehicle system in order to assist the vehicle indexing system in moving (e.g., indexing) each of one or more vehicles of the vehicle system to indexing positions (where cargo may be loaded and/or unloaded) without the vehicle system being separated into two or more vehicle systems (and moved solely from force provided by the indexing system). The systems and methods determine operational power settings of the vehicle indexing system to index vehicles of the vehicle system. The systems and methods determine vehicle power settings for the vehicle system in order for the vehicle system to provide additional tractive effort to the vehicle indexing system to index vehicles of the vehicle system. Additionally or alternatively, the systems and methods determine the vehicle power settings or propulsive forces for the vehicle system in order for the vehicle system to provide the full tractive effort to index the vehicles of the vehicle system. For example, if the vehicle indexing system fails and/or breaks, the vehicle system may provide the full tractive effort to index (e.g., move) the vehicles without the use of the vehicle indexing system. Optionally, the systems and methods determine a fault state of one or more of a braking system or a route traveled by the vehicle system based on the tractive effort provided by or needed from the vehicle system to assist the indexing system.

Figure 1:
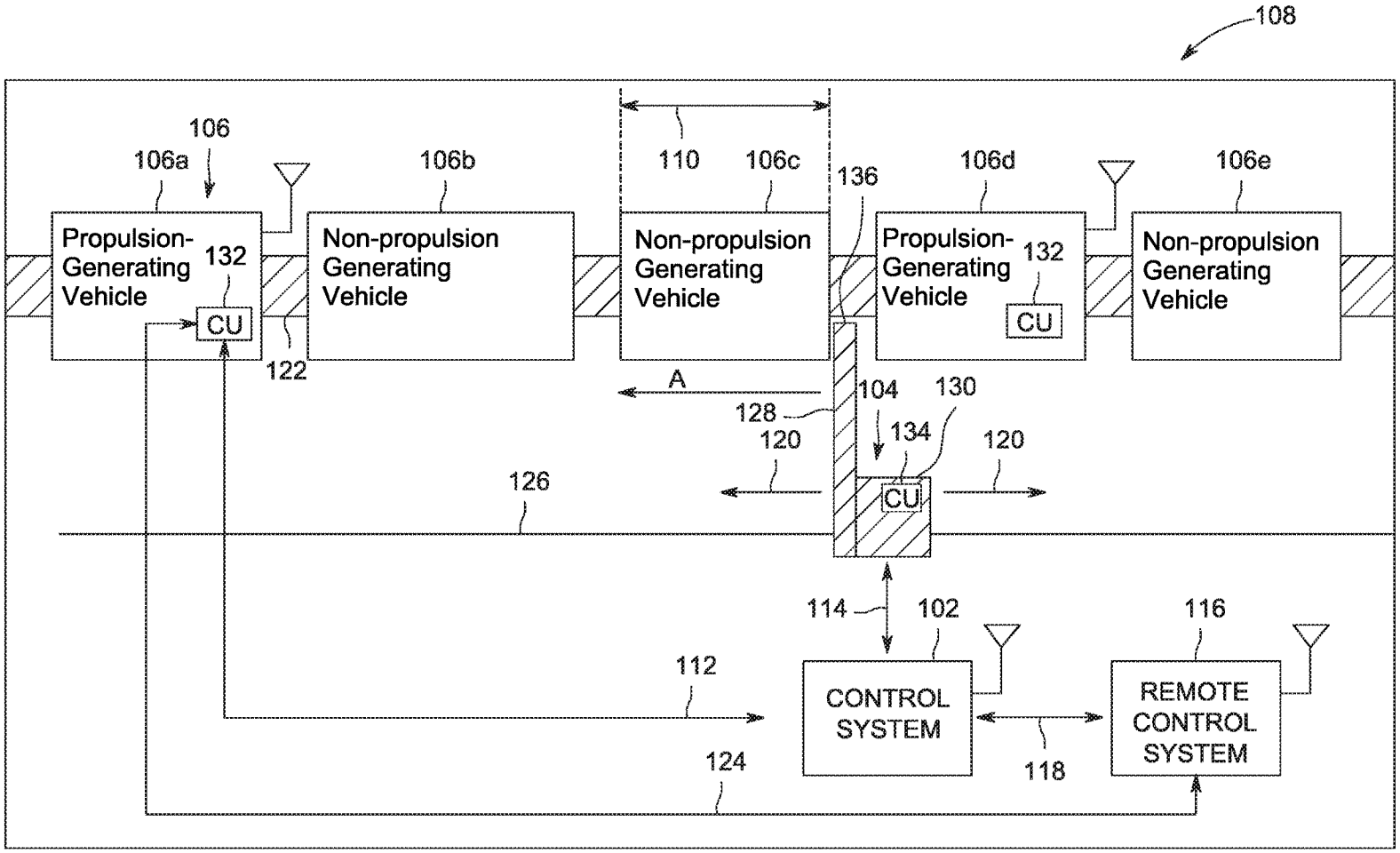
FIG. 1 illustrates a schematic illustration of a vehicle system and vehicle indexing system in accordance with one embodiment.

FIG. 1 illustrates one embodiment of a vehicle system 108 and a vehicle indexing system 104. The vehicle system 108 may be formed from a single vehicle 106, or two or more vehicles 106 traveling together along a route 122. The vehicles may or may not be mechanically coupled with each other. The vehicles may be propulsion-generating vehicles (e.g., locomotives, automobiles, other freight or passenger rail vehicles, or rail-based ore carts or other mining equipment) and/or non-propulsion generating vehicles (e.g., rail cars, trailers, barges, mining baskets, etc). The illustrated vehicle system 108 represents a rail vehicle system, such as a train. Optionally, the vehicles may be other off-highway vehicles (e.g., electric mine haul trucks or heavy construction equipment), marine vessels, and/or other vehicles generally (including automobiles, such as driverless cars). The vehicle system 108 travels along the route 122, which can represent a track, road, waterway, or the like.

The vehicle system 108 may comprise one or more vehicles that travel along the route 122. The vehicle system 108 can include one or more propulsion-generating vehicles 106 and/or one or more cargo-carrying vehicles 106*a*, 106*b*, 106*c*, 160*d*, 106*e*. In one embodiment, the vehicles 106 may also carry cargo and/or the vehicle system 108 may only be formed from one or more of the vehicles 106. The vehicles 106 can represent locomotives, automobiles, or other vehicles that generate tractive effort or force to move the vehicles 106 and vehicle system 108 along the route 108. The cargo-carrying vehicles 106*b*, 106*c*, 106*e* can represent rail cars, trailers, or other vehicles that move along the route 122 but that may not generate tractive effort or force. The vehicles 106*a*, 106*d* comprise an on-board control unit 132. For example, the vehicles 106*a*, 106*d* of the vehicle system 108 are propulsion-generating vehicles that comprise the on-board control unit 132 located on each vehicle 106*a* and vehicle 106*b* that control movement of the respective vehicles 106*a*, 106*b*. The vehicles 106*b*, 106*c*, 106*e* may not comprise an on-board control unit. Additionally or alternatively, one or more vehicles 106, or each vehicle 106 of the vehicle system 108 may include a control unit that operates in order to control movement of the respective vehicle of the vehicle system 108.

A control system 102 controls operations of the vehicle indexing system 104 and/or operations of the vehicle 106 of the vehicle system 108. A remote control system 116 communicates with the control system 102 and controls operations of the vehicles 106 of the vehicle system 108. The control system 102 and the remote control system 116 will be described in further detail below with FIG. 2 and FIG. 3.

The vehicle indexing system 104 comprises an indexing arm 128 and an indexing body 130. The indexing arm 128 extends away from the indexing body 130. The indexing arm 130 extends in a direction toward the vehicle system 108. The indexing arm 130 may extend to an end 136 that engages with a vehicle 106 of the vehicle system 108 or another portion of the arm 130 may engage the vehicle system 108. Additionally or alternatively, the indexing system 104 may comprise two or more indexing arms 128.

The vehicle indexing system 104 travels along an indexing route 126, which can represent a track, road, waterway, or the like. The vehicle indexing system 104 is configured to travel in one or more directions 120 along the indexing route 126. For example, the vehicle indexing system 104 travels in a back and forth manner along the indexing route 126. Alternatively or additionally, the vehicle indexing system may travel in additional directions along an alternative indexing route. In the embodiment of FIG. 1, the vehicle indexing system 104 is configured to travel in the direction 120 in a direction designated by the vector A in order to index the vehicles 106 of the vehicle system 108. Optionally, the vehicle indexing system 104 may be configured to index the vehicles 106 of the vehicle system 108 in an alternative direction. In the embodiment of FIG. 1, the vehicle indexing system 104 is configured to push the vehicle 106 of the vehicle system 108 in the direction designated by vector A. Additionally or alternatively, the vehicle indexing system may be configured to pull the vehicle 106 of the vehicle system 108 in the direction designated by vector A.

The vehicle indexing system 104 comprises an indexing control unit 134. The indexing control unit 134 may be disposed onboard the vehicle indexing system 104. Additionally or alternatively, the indexing control unit 134 may be off-board the vehicle indexing system 104. The components of the indexing control unit 134 will be described in further detail below.

The vehicle indexing system 104 indexes the vehicle 106 of the vehicle system 108 into an indexing position 110. The vehicle indexing system 104 indexes the vehicles 106 into the indexing position 110 by moving (e.g., pushing and/or pulling) the vehicles 106 in the direction designated by vector A. For example, the vehicle indexing system 104 indexes (e.g. moves) the vehicle 106*c* into the indexing position 110 as illustrated in FIG. 1. The indexing position 110 may be a predetermined location along the route 122. The indexing position 110 is a target position into which each vehicle 106 of the vehicle system 108 is to be individually positioned for loading and/or unloading of cargo onto the vehicle when the vehicle is in the indexing position 110. The indexing position 110 in the embodiment of FIG. 1 is generally the length of one vehicle 106. For example, the indexing position 110 may be 90-110% of the total length of one vehicle 106. Additionally or alternatively, the indexing position 110 may be a length shorter than 90% of the total length of one vehicle 106. Additionally or alternatively, the indexing position 110 may be a length greater than 110% of the total length of one vehicle 106. Additionally or alternatively, the indexing position 110 may be a predetermined area that is generally the length of more than one vehicles 106 of the vehicle system 108. For example, the indexing position 110 may be 90-110% of the length of two vehicles 106 of the vehicle system 108. The indexing position 110 may be a predetermined length that is a length shorter than 90% of the total length of two or more vehicles 106 of the vehicle system 108. Additionally or alternatively, the indexing position 110 may be a predetermined length that is a length greater than 110% of the total length of two or more vehicles 106 of the vehicle system 108.

The vehicle indexing system 104 indexes the vehicles 106 of the vehicle system 108 into the indexing position 110. After the vehicle indexing system 104 indexes a first vehicle 106 into the indexing position 110, the end 136 of the indexing arm 128 disengages from the vehicle 106. The vehicle indexing system 104 moves in a direction opposite of vector A along the indexing route 126. The vehicle indexing system 104 moves in a direction towards a second vehicle. The second vehicle is positioned behind or towards a rear end of the first vehicle. The end 136 of the indexing arm 128 engages with the second vehicle. The vehicle indexing system indexes (e.g., moves) the second vehicle towards the indexing position 110 in the direction of vector A. For example, the vehicle indexing system 104 indexes the vehicle 106*c* into the indexing position 110. The end 136 of the indexing arm 128 disengages with the vehicle 106*c*. The vehicle indexing system 104 moves in the direction opposite of vector A along the indexing route 126 towards the vehicle 106*d* until the end 136 of the indexing arm 128 engages with the vehicle 106*d* (e.g., the second vehicle). The vehicle indexing system 104 indexes (e.g., moves) the vehicle 106*d* towards the indexing position 110 in the direction of vector A along the indexing route 126.

The indexing position 110 may be a predetermined position along the route 122 corresponding to a location where cargo of the vehicles 106 of the vehicle system is unloaded and/or loaded. The vehicle indexing system 104 may index each vehicle 106 of the vehicle system 108 until each vehicle 106 is indexed. The vehicles 106 may be indexed in order to unload and/or load cargo into vehicles 106 of the vehicle system 108. In the present embodiment, the vehicle 106*c* is positioned in the indexing position 110. For example, the vehicle 106*c* may be loaded and/or unloaded with cargo. When the cargo is loaded into vehicle 106*c* and/or unloaded from vehicle 106*c*, the vehicle indexing system 104 moves in the direction opposite of vector A towards vehicle 106*d*. The vehicle indexing system 104 moves the vehicle 106*d* towards the indexing position 110. For example, the vehicle indexing system 104 moves the vehicles 106*d* towards the indexing position 110 in order to load and/or unload cargo of vehicle 106*d*. The vehicle indexing system 104 indexes each vehicle of the vehicle system 108 until cargo is loaded and/or unloaded from each vehicle of the vehicle system that carries cargo.

Figure 2:
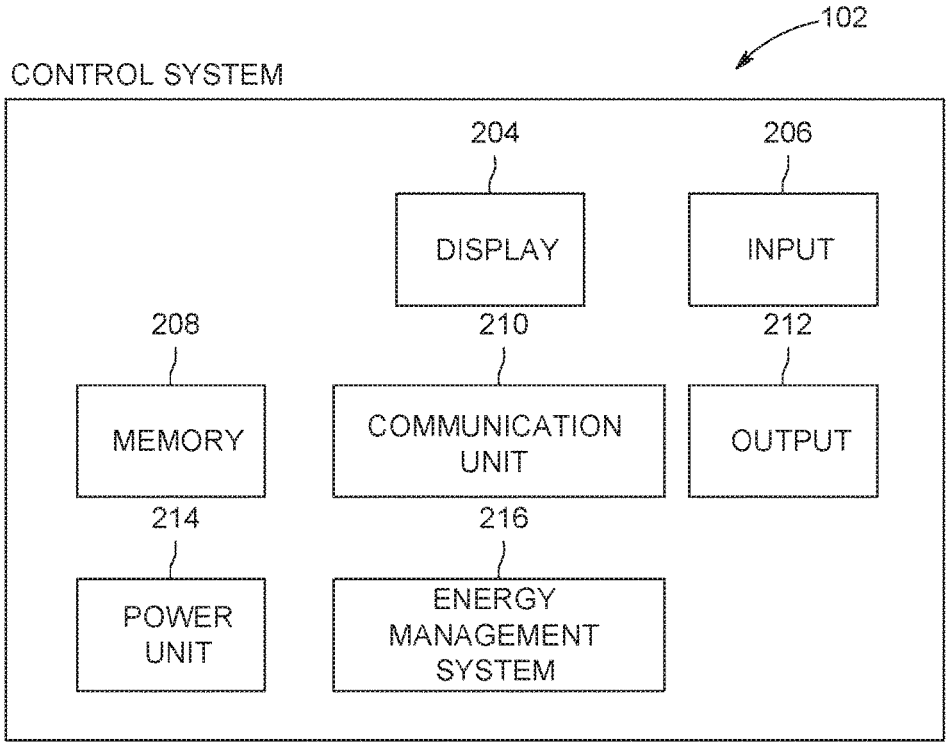
FIG. 2 illustrates a schematic illustration of a control system in accordance with one embodiment.

FIG. 2 illustrates the control system 102. The control system 102 controls operations of the vehicle indexing system 104. The control system 102 represents hardware circuitry that includes and/or is connector with one or more processors (e.g., microprocessors, controllers, field programmable gate arrays, integrated circuits, etc). The control system 102 generates signals that are communicated by a communication unit 210. For example, the control system 102 may communicate signals to a propulsion system of the on-board control unit 132 of the vehicle 106. Optionally, the control system 102 generates signals that are communicated by the communication unit 210 to a propulsion system of the indexing control unit 134 of the vehicle indexing system 104. The generated signals may include one or more of throttle notch settings, speed settings, power settings, brake settings, alert notifications, or the like.

The control system 102 can include one or more input devices 206 and/or output devices 212 such as a keyboard, an electronic mouse, stylus, microphone, or the like for communicating with an operator of the vehicle system 108. Additionally or alternatively, the input and/or output devices may be used to communicate with an operator of the vehicle indexing system 104. The input and/or output devices may be used to communicate with an operator of the remote control system 116. The control system 102 can include one or more displays 204 such as a touchscreen, display screen, or the like. The control system 102 is operably connected with components of the vehicle indexing system 104. Additionally or alternatively, the control system 102 is operably connected with components of the remote control system 116. The control system 102 may be operably connected with components of the vehicle 106. Additionally or alternatively, the control system 102 may be operably connected with components of alternative systems.

The control system 102 can include an energy management system (EMS) 216 (also referred to herein as a controller). The EMS 216 may determine a power setting for the vehicle indexing system 104. The power setting for the vehicle indexing system 104 may be communicated by the control system 102. The power setting includes operational settings of the vehicle indexing system 104 to dictate how the vehicle indexing system 104 is to travel along the indexing route 126. The power setting may include throttle notch settings, acceleration settings, speed settings, brake settings, or the like, that direct how the vehicle indexing system 104 is to operate. For example, the EMS 216 may determine a power setting for the vehicle indexing system 104 in order for the vehicle indexing system 104 to index the vehicle 106*c* of the vehicle system 108 into the indexing position 110 wherein the vehicle 106*c* carries cargo. Additionally or alternatively, the EMS 216 may determine an alternative power setting to index the vehicle 106*c* into the indexing position wherein the vehicle 106*c* does not carry cargo (e.g., the vehicle 106*c* with cargo has a greater weight than the vehicle 106*c* without cargo). For example, the EMS 216 may determine a power setting in order for the vehicle indexing system 104 to index the vehicle 106*c* into the indexing position to unload cargo. After the cargo of vehicle 106*c* is unloaded, the EMS 216 may determine an alternative power setting in order for the vehicle indexing system 104 to index the vehicle 106*d* into the indexing position in order to unload cargo carried by the vehicle 106*d*. The alternative power setting determined by the EMS 216 to index vehicle 106*d* may differ from the power setting determined by the EMS 216 to index vehicle 106*c*. For example, after the cargo of the vehicle 106*c* is unloaded, the weight of the vehicle system 108 is less than the weight of the vehicle system 108 before the cargo of vehicle 106*c* has been unloaded. The reduced weight of the vehicle system 108 after the cargo of vehicle 106*c* is unloaded may require an alternative power setting for the vehicle indexing system 104 to index the vehicle 106*d* into the indexing position 110. Additionally or alternatively, the vehicle indexing system 104 may index vehicles of the vehicle system 108 in order to load cargo. For example, after the cargo of the vehicle 106*c* is loaded, the weight of the vehicle system 108 is greater than the weight of the vehicle system 108 before the cargo of vehicle 106*c* has been loaded. The increased weight of the vehicle system 108 when the cargo of the vehicle 106*c* has been loaded may require an alternative power setting for the vehicle indexing system 104 to index the vehicle 106*d* into the indexing position.

The EMS 216 may determine a unique power setting to index each vehicle 106 of the vehicle system 108. Additionally or alternatively, the EMS 216 may determine a common power setting to index one or more vehicles 106 of the vehicle system 108. Optionally, the EMS 216 may determine a common power setting to index a number of vehicles of the vehicle system and a unique power setting to index a number of vehicles of the vehicle system. For example, the EMS 216 may determine a common power setting C to index the vehicles 106*a*, 106*b*. The EMS 216 may determine an alternative common power setting D to index the vehicles 106*c*, 106*d*, wherein the power setting C is unique to the power setting D.

The control system 102 may communicate the determined power setting to the vehicle indexing system 104 by way of path 114 (of FIG. 1). The control system 102 may communicate the power settings from the communications unit 210 to a propulsion system 520 (of FIG. 5) of the indexing control unit 134 of the vehicle indexing system 104.

The EMS 216 may determine a vehicle power setting for the vehicle system 108. The vehicle power setting of the vehicle system 108 may be communicated by the communication unit 210 of the control system 102 to the on-board control unit 132 of the vehicle system 108. The vehicle power setting includes operational settings for the vehicle system 108 that dictate how the vehicle system 108 is to travel along the route 122. The vehicle power setting may include throttle notch settings, acceleration settings, speed settings, brake settings, or the like, that control the vehicle system 108. The EMS 216 may determine the vehicle power setting of the vehicle system 108 based on the power setting of the vehicle indexing system 104. The vehicle power setting is determined to control operations of the vehicle system 108 in order to provide additional tractive effort to the vehicle indexing system 104 in order to move one or more vehicles 106 into the indexing position 110. For example, the EMS 216 of the control system 102 may determine a power setting for the vehicle indexing system 104 in order to index the vehicle 106*c* of the vehicle system 108 into the indexing position wherein the vehicle 106*c* carries cargo. The EMS 216 may also determine a vehicle power setting for the vehicle system 108 based on the power setting of the vehicle indexing system 104 in order for the vehicle system 108 to provide the additional tractive effort in order to assist the vehicle indexing system 104 to move the vehicles into the indexing position 110. Additionally or alternatively, the EMS 216 may determine a vehicle power setting for the vehicle system 108 to provide the full tractive effort or propulsive force to index the vehicles 106 of the vehicle system 108 without the use of the vehicle indexing system 104. For example, the vehicle indexing system 104 may malfunction and/or break. The EMS 216 may determine the vehicle power settings for the vehicle system 108 to index the vehicles 106 when the vehicles indexing system 104 is unavailable.

The vehicle power setting of the vehicle system 108, with the power setting of the vehicle indexing system 104, together move the vehicles 106 into the indexing position 110. For example, the EMS 216 may determine a power setting for the vehicle indexing system 104 and a vehicle power setting for the vehicle system 108 in order to index the vehicle 106*c* into the indexing position 110, wherein the vehicle power setting provides additional tractive effort from the vehicle system 108 to the vehicle indexing system 104. For example, the vehicle indexing system 104 indexes the vehicle 106*c* into the indexing position. However, the weight of the vehicle system 108 is too great for the vehicle indexing system 104 to independently index the vehicle system 108. The EMS 216 identifies the discrepancy and the control system 102 communicates the vehicle power settings to the vehicle system 108. The vehicle power setting is determined in order for the vehicle system 108 to assist the vehicle indexing system 104 to index the vehicle 106*c* into the indexing position. Additionally or alternatively, the EMS 216 may determine the vehicle indexing system 104 is capable of moving the vehicles 106 into the indexing position without the additional tractive effort from the vehicle system 108. The EMS 216 may communicate the power setting to the vehicle indexing system 104, and may not communicate a vehicle power setting to the vehicle system 108.

The control system 102 may communicate the determined vehicle power setting to the vehicle system 108 by way of path 112 (of FIG. 1). The control system 102 may communicate the vehicle power setting from the communications unit 210 to a propulsion system 420 (of FIG. 4) of the on-board control unit 132 of the vehicle system 108.

The EMS 216 may determine a unique vehicle power setting to index each vehicle 106 of the vehicle system 108. Additionally or alternatively, the EMS 216 may determine a common vehicle power setting to index one or more vehicles 106 of the vehicle system 108. Additionally or alternatively, the EMS 216 may determine a common vehicle power setting to index a number of vehicles of the vehicle system and a unique vehicle power setting to index a number of vehicles of the vehicle system. For example, the EMS 216 may determine a common vehicle power setting E to index the vehicles 106*a*, 106*b*. The EMS 216 may determine an alternative common vehicle power setting F to index the vehicles 106*c*, 106*d*, wherein the vehicle power setting E is unique to the vehicle power setting F.

The control system 102 can include a power unit 214 and a memory 208. The power unit 214 may provide electrical power to the vehicle system 108. Additionally or alternatively, the power unit 214 may power the control system 102. For example, the power unit 214 may be a battery and/or circuitry that supplies electrical current to power other components of the control system 102. The memory 208 may store the determined power setting for controlling the vehicle indexing system 104. Additionally or alternatively, the memory 208 may store the determined vehicle power setting for controlling the vehicle system 108. For example, the memory 208 may store the power setting and the vehicle power setting corresponding to each vehicle 106 of the vehicle system 108. The memory may communicate the determined power settings and determined vehicle power settings to the EMS 216 for a second vehicle system, wherein the second vehicle system is similar to the vehicle system 108. For example, a second vehicle system carries the same cargo and/or comprises the same number of vehicles as vehicle system 108. The control system 102 may communicate the determined power settings and determined vehicle power settings from the memory 208 rather than the EMS 216 determine new power settings and new vehicle power settings for the second vehicle system.

Figure 3:
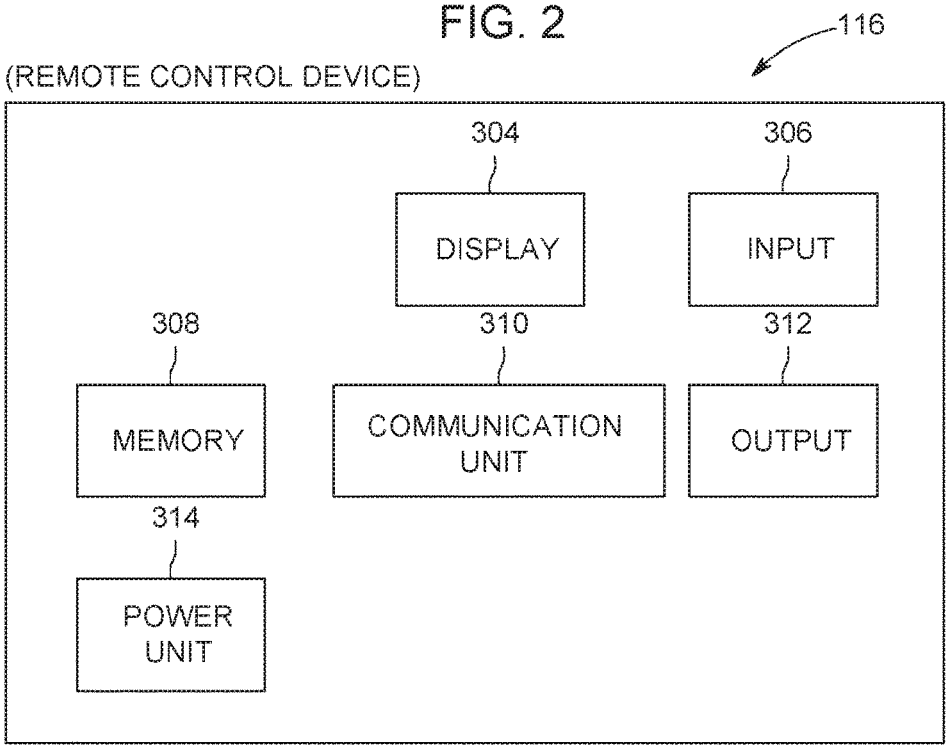
FIG. 3 illustrates a schematic illustration of a remote control system in accordance with one embodiment.

FIG. 3 illustrates the remote control system 116. In one embodiment, the control system 102 communicates the determined vehicle power settings to the remote control system 116. The remote control system 116 may control operations of the vehicle system 108. The remote control system 116 represents hardware circuitry that includes and/ or is connector with one or more processors (e.g., microprocessors, controllers, field programmable gate arrays, integrated circuits, etc). The remote control system 116 generates signals that are communicated by a communication unit 310 to the propulsion system 420 of the on-board control unit 132 of the vehicle 106. The signals may include one or more of throttle notch settings, speed settings, brake settings, power settings, alert notifications, or the like, that control the operation of the vehicle system 108.

The remote control system 116 can include one or more input devices 306 and/or output devices 312 such as a keyboard, an electronic mouse, stylus, microphone, or the like for communicating with an operator of the vehicle system 108. Additionally or alternatively, the input and/or output devices may be used to communicate with an operator of the control system 102. Optionally, the input and/or output devices may be used to communicate with an operator of an alternative system. The remote control system 116 can include one or more displays 304 such as a touchscreen, display screen, or the like. The remote control system 116 is operably connected with components of the vehicle system 108. Additionally or alternatively, the remote control system 116 is operably connected with components of the control system 102. Optionally, the remote control system 116 is operably connected with components of alternative systems The remote control system 116 can include a power unit 314. The power unit 314 may provide electrical power to the vehicle system 108. Additionally or alternatively, the power unit 314 may power the remote control system 116. For example, the power unit 314 may be a battery and/or circuitry that supplies electrical current to power other components of the remote control system 116.

The remote control system 116 receives determined vehicle power settings from the control system 102. The remote control system 116 receives the determined vehicle power settings from the control system 102 by path 118 (of FIG. 1). The remote control system 116 may communicate the determined vehicle power settings by the communication unit 310 to one or more of the on-board control unit 132 of the vehicle system 108. For example, the remote control system 116 receives the determined vehicle power settings from the control system 102. The vehicle power settings are determined by the EMS 216 of the control system 102 based on the power settings of the vehicle indexing system 104. The remote control system 116 communicates the vehicle power settings to the propulsion system 420 of the on-board control unit 132. For example, the remote control system 116 communicates the vehicle power setting to the on-board control unit 132 by way of path 124 (of FIG. 1).

A memory 308 may store the received determined vehicle power setting. For example, the memory 308 may store the determined vehicle power settings communicated by the control system 102 for each vehicle 106 of the vehicle system 108. The remote control system 116 may communicate the stored vehicle power settings from the memory 308 to the on-board control unit 132 for a second vehicle system, wherein the second vehicle system is similar to the vehicle system 108. For example, a second vehicle system carries the same cargo and/or comprises the same number of vehicles as vehicle system 108. The remote control system 116 may communicate the stored determined vehicle power settings from the memory 308 rather than communicate new vehicle power settings received from the control system 102.

Figure 4:
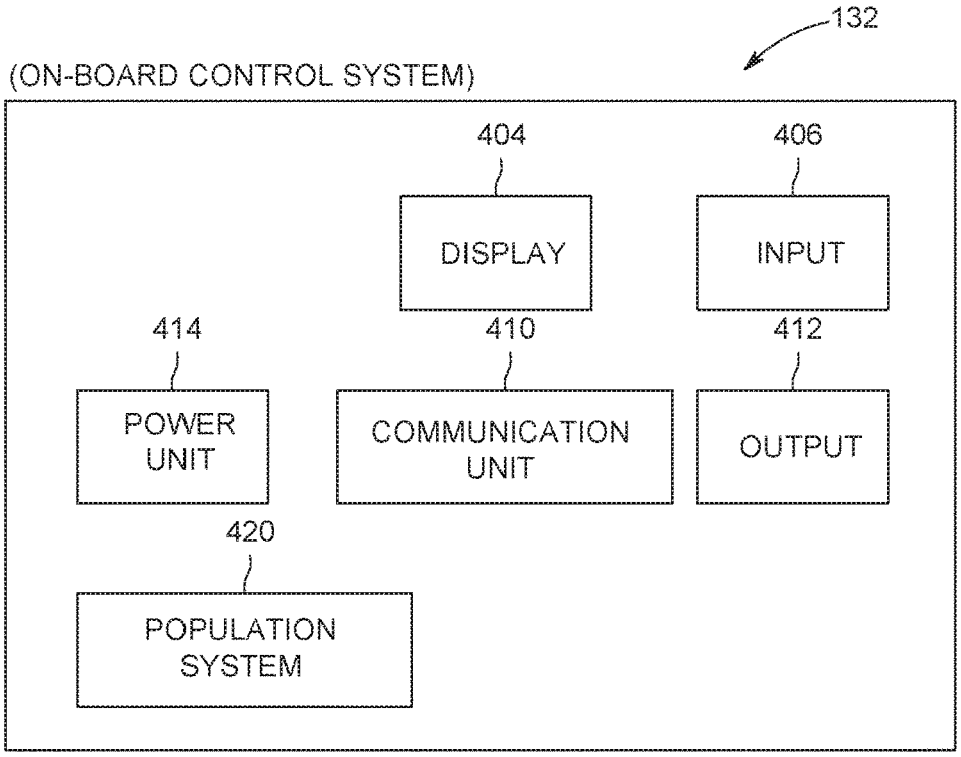
FIG. 4 illustrates a schematic illustration of an on-board control unit in accordance with one embodiment.
Figure 5:
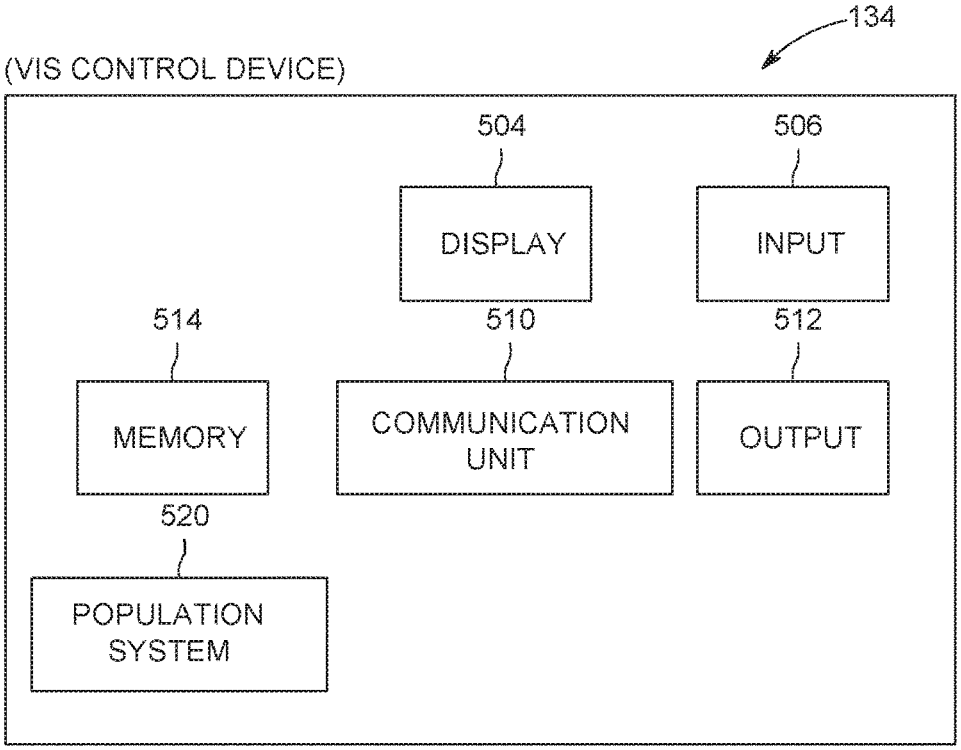
FIG. 5 illustrates a schematic illustration of an indexing control unit in accordance with one embodiment.

FIG. 4 illustrates the on-board control unit 132. The on-board control unit 132 controls operations of the vehicle 106 of the vehicle system 108. The on-board control unit 132 represents hardware circuitry that includes and/or is connector with one or more processors (e.g., microprocessors, controllers, field programmable gate arrays, integrated circuits, etc). The on-board control unit 132 receives operational settings from the control system 102 and/or the remote control system 116 for controlling operations of the vehicles 106. FIG. 5 illustrates the indexing system control unit 134. The indexing system control unit 134 controls operations of the vehicle indexing system 104. The indexing system control unit 134 represents hardware circuitry that includes and/or is connector with one or more processors (e.g., microprocessors, controllers, field programmable gate arrays, integrated circuits, etc). The indexing system control unit 134 receives operational settings from the control system 102 for controlling operations of the vehicle indexing system 104. The components of the on-board control unit 132 and the indexing system control unit 134 are similar and will be discussed in detail together.

The on-board control unit 132 and the indexing system control unit 134 can include one or more input devices 406, 506 and/or output devices 412, 512, such as a keyboard, an electronic mouse, stylus, microphone, or the like for communicating with an operator of the vehicle system 108 and/or vehicle indexing system 104. Additionally or alternatively, the input and/or output devices may be used to communicate with an operator of the control system 102. Optionally, the input and/or output devices may be used to communicate with an operator of the remote vehicle system 116. The control units 132, 134 can include one or more displays 404, 504 such as a touchscreen, display screen, or the like.

The on-board control unit 132 is operably connected with components of the vehicle system 108. Additionally or alternatively, the on-board control unit 132 is operably connected with components of the control system 102. Optionally, the on-board control unit 132 is operably connected with components of the remote control system 116. The on-board control unit 132 may be operably connected with components of the vehicle indexing system 104.

The indexing system control unit 134 is operably connected with components of the control system 102. Additionally or alternatively, the indexing system control unit 134 is operably connected with components of the vehicle indexing system 104. Optionally, the indexing system control unit 134 may be operably connected with components of the remote control system 116. The indexing system control unit 134 may be operably connected with components of the vehicle system 108. Additionally or alternatively, the control units 132, 134 may be operably connected with components of an alternative system.

The on-board control unit 132 and the indexing system control unit 134 can include power units 414, 514 respectively. The power units 414, 514 may provide electrical power to the control units 132, 134. Additionally or alternatively, the power units 414, 514 may provide electrical power to the vehicle system 108 and/or the vehicle indexing system 104. For example, the power units 414, 514 may be a battery and/or circuitry that supplies electrical current to power other components of the control units 132, 134.

The on-board control unit 132 receives signals that are communicated by the control system 102 by path 112 (of FIG. 1). Optionally, the on-board control unit 132 receives signals that are communicated by the remote control system 116 by path 124. The signals are received by a communication unit 410 of the on-board control unit 132. The signals may include one or more of throttle notch settings, speed settings, brake settings, power settings, alert notifications, or the like that control the operation of the vehicle system 108.

The communication unit 410 may communicate the received operational signals to the propulsion system 420 (e.g., motors, alternators, generators, etc) of the on-board control unit 132. The propulsion system 420 may control the operational settings of the vehicle 106 of the vehicle system 108. For example, the control system 102 may communicate to the communication unit 410 of the on-board control unit 132 to increase the throttle notch setting to level 3. The communication unit 410 may communicate the received throttle notch setting to the propulsion system 420 in order for the propulsion system 420 to change the throttle notch setting and to change the operational setting of the vehicle 106 of the vehicle system 108.

The indexing system control unit 134 receives signals that are communicated by the control system 102 by path 114. The signals are received by a communication unit 510 of the indexing system control unit 134. The signals may include one or more of throttle notch settings, speed settings, brake settings, power settings, alert notifications, or the like that control the operation of the vehicle indexing system 104.

The communication unit 510 may communicate the received operational signals with the propulsion system 520 (e.g., motors, alternators, generators, etc) of the indexing system control unit 134. The propulsion system 520 may control the operational settings of the vehicle indexing system 104. For example, the control system 102 may communicate to the communication unit 510 of the indexing system control unit 134 to increase the throttle notch setting to level 5. The communication unit 510 may communicate the received throttle notch setting to the propulsion system 520 in order for the propulsion system 520 to change the throttle notch setting and to change the operational setting of the vehicle indexing system 104.

Figure 6:
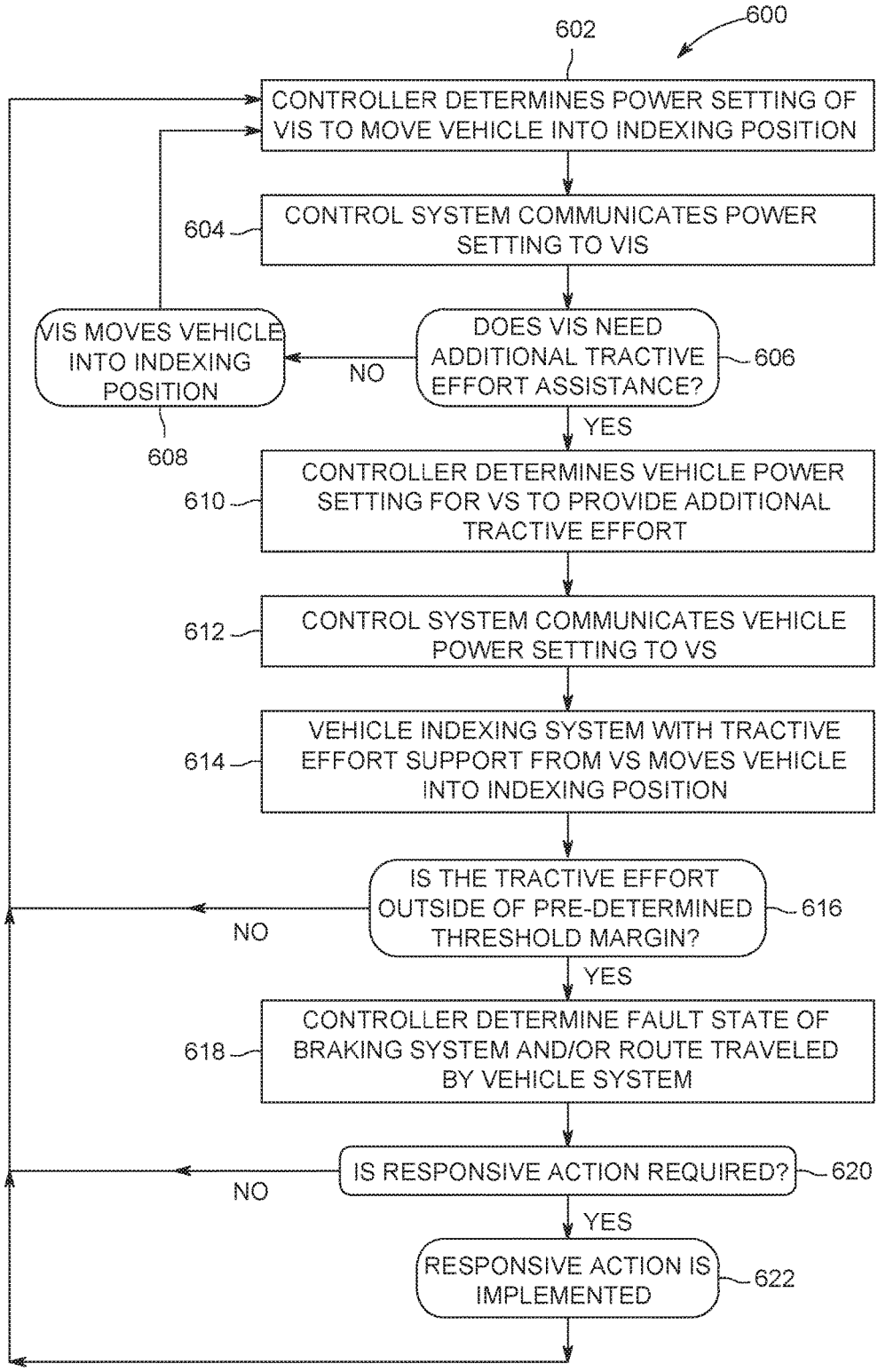
FIG. 6 illustrates a flowchart of a method for determining power settings in accordance with one embodiment.

FIG. 6 illustrates a flowchart of one embodiment of a method 600 for determining the power settings for the vehicle indexing system 104 and for determining the vehicle power settings for the vehicle system 108. At 602, the EMS 216 of the control system 102 determines a power setting for the vehicle indexing system 104 in order for the vehicle indexing system 104 to index the vehicle 106 into the indexing position 110. For example, the EMS 216 determines the power setting for the vehicle indexing system 104 to be a throttle notch setting 10 in order for the vehicle indexing system 104 to index the vehicle 106*c* into the indexing position to unload the cargo carried by vehicle 106*c*. The power setting may be determined based on the cargo the vehicle system 108 carries, the number of vehicles 106 of the vehicle system 108, the cargo that will be loaded into the vehicle system 108, or the like. At 604, the control system 102 communicates the determined power setting to the indexing system control unit 134 of the vehicle indexing system 104 to index the vehicle 106 into the indexing position 110. For example, the control system communicates to the vehicle indexing system 104 the throttle notch setting 10 that the vehicle indexing system 104 should operate in order for the vehicle indexing system 104 to index the vehicle 106*c* into the indexing position 110 to unload cargo carried by vehicle 106*c*.

At 606, a determination is made to whether the vehicle indexing system 104 needs additional tractive effort assistance from the vehicle system 108. For example, the power setting throttle notch setting 10 for the vehicle indexing system 104 may be the maximum power setting the vehicle indexing system can operate. The EMS 216 determines that in order to index the vehicle 106*c* into the indexing position, the power setting throttle notch setting is not enough power to index the vehicle 106*c* of the vehicle system 108. For example, in order to move the vehicle system 108, the vehicle indexing system 104 requires tractive effort support. If it is determined that the vehicle indexing system 104 can index the vehicle 106 without additional tractive effort support, flow of the method 600 proceeds towards 608. At 608, the vehicle indexing system 104 indexes the vehicle 106*c* into the indexing position 110 to load and/or unload cargo, then flow of the method proceeds back to 602. Alternatively, if it is determined that the vehicle indexing system 104 does require additional tractive effort support, flow of the method 600 proceeds towards 610.

At 610, the EMS 216 of the control system 102 determines the vehicle power setting for the vehicle system 108 to operate in order for the vehicle system 108 to provide additional tractive effort to the vehicle indexing system 104. The EMS 216 determines the vehicle power setting based on the determined power setting of the vehicle indexing system 104. For example, the EMS 216 determines the power setting for the vehicle indexing system 104 to operate at a throttle notch setting 10. Additionally, the EMS 216 determines that in order to index the vehicle 106*c* into the indexing position 110, the vehicle indexing system 104 needs additional tractive effort provided by the vehicle system 108. The EMS 216 determines a throttle notch setting 15 for the vehicle power setting of the vehicle system 108 in order for the vehicle system 108 to provide additional tractive effort to the vehicle indexing system 104. For example, the vehicle indexing system 104 does not have enough power to independently index the vehicle system 108. The vehicle system 108 assists the vehicle indexing system 104 to index the vehicles 106 of the vehicle system 108 into the indexing position 110 to load and/or unload cargo.

At 612, the control system 102 communicates the determined vehicle power setting to the on-board control unit 132 of the vehicle system 108 to assist the vehicle indexing system 104 to index the vehicle 106 into the indexing position 110. For example, the control system 102 communicates the vehicle power setting throttle notch setting 15 to the vehicle system 108 that the vehicle system 108 should operate in order to provide additional tractive effort to the vehicle indexing system 104. The additional tractive effort by the vehicle system 108 assists the vehicle indexing system 104 to index the vehicle 106*c* into the indexing position 110 to unload cargo carried by the vehicle 106*c*.

At 614, the vehicle indexing system 104, with the additional tractive effort from the vehicle system 108, indexes the vehicle into the indexing position 110. For example, the vehicle indexing system 104 has a power setting throttle notch setting 10. The vehicle system 108 has a vehicle power setting throttle notch setting 15. The power setting of the vehicle indexing system 104, with the additional tractive power effort by the vehicle system 108, indexes the vehicle 106*c* into the indexing position 110.

At 616, a determination is made to whether the additional tractive effort vehicle power setting exceeds a predetermined threshold margin. The EMS 216 may include a predetermined threshold margin within which the vehicle power setting is to operate. The predetermined threshold margin may include a lower operational setting limit and/or an upper operational setting limit. The EMS 216 may determine whether the vehicle power setting is outside of the threshold margin. For example, the predetermined threshold margin may be a throttle notch setting between power 1 (e.g., the lower limit) and power 10 (e.g., the upper limit). The EMS 216 determines that the vehicle power setting throttle notch setting 15 exceeds the predetermined threshold margin. The predetermined threshold margin may identify a fault state of one or more of a braking system or the vehicle system 108 and/or a fault state of the route 122. If the vehicle power setting throttle notch setting is outside of the threshold margin, then flow of the method 600 proceeds towards 618. Alternatively, flow of the method 600 proceeds towards 602.

At 618, the EMS 216 determines a fault state of one or more of a braking system or the route 122 traveled by the vehicle system 108 based on the additional tractive effort of the vehicle system 108. The fault state may be a result of a braking system functioning incorrectly. Additionally or alternatively, the fault state may be a result of the vehicles 106 carrying a cargo load that varies from the anticipated cargo load. Optionally, the fault state may be a result of a foreign object located on the route 122 that is preventing the vehicle system 108 to travel the route 122. The fault state may be a result of another error of the vehicle system 108. For example, the EMS 216 may determine that the vehicle power setting throttle notch setting 15 that exceeds the predetermined threshold value 10 is a result of the braking system of the vehicle system 108 functioning incorrectly.

At 620 a determination is made to whether a responsive action to the identified fault state is required and the responsive action is identified. The responsive action could include scheduling an inspection of the route 122. Additionally or alternatively, the responsive action could include modification of the predetermined threshold margin. Optionally, the responsive action could be modification of the predetermined threshold margin based on a non-anticipated cargo load. The responsive action could be to schedule an inspection of a braking system of the vehicle system 108. Additionally or alternatively, the responsive action may be to schedule an inspection of the vehicle indexing system 104. If it is determined that a responsive action is not required, flow of the method 600 proceeds towards 602. Alternatively, flow of the method 600 proceeds towards 622. For example, the EMS 216 determines that the identified fault state of the braking system of the vehicle system 108 functioning incorrectly requires a responsive action to be taken. The responsive action may be to schedule an inspection of the braking system of the vehicle system 108.

At 622, the responsive action identified at 620 is implemented. Flow of the method 600 then proceeds towards 602 to proceed with a next vehicle 106 of the vehicle system 108. For example, after the vehicle 106*c* is indexed into the indexing position, cargo carried by the vehicle 106*c* is unloaded, and the responsive action to the braking system functioning incorrectly is taken, then flow of the method proceeds towards 602 for the vehicle 106*d*. The method 600 continues until all vehicles 106 of the vehicle system 108 that are determined to be required to be indexed are indexed into the indexing position 110.

Figure 7A:
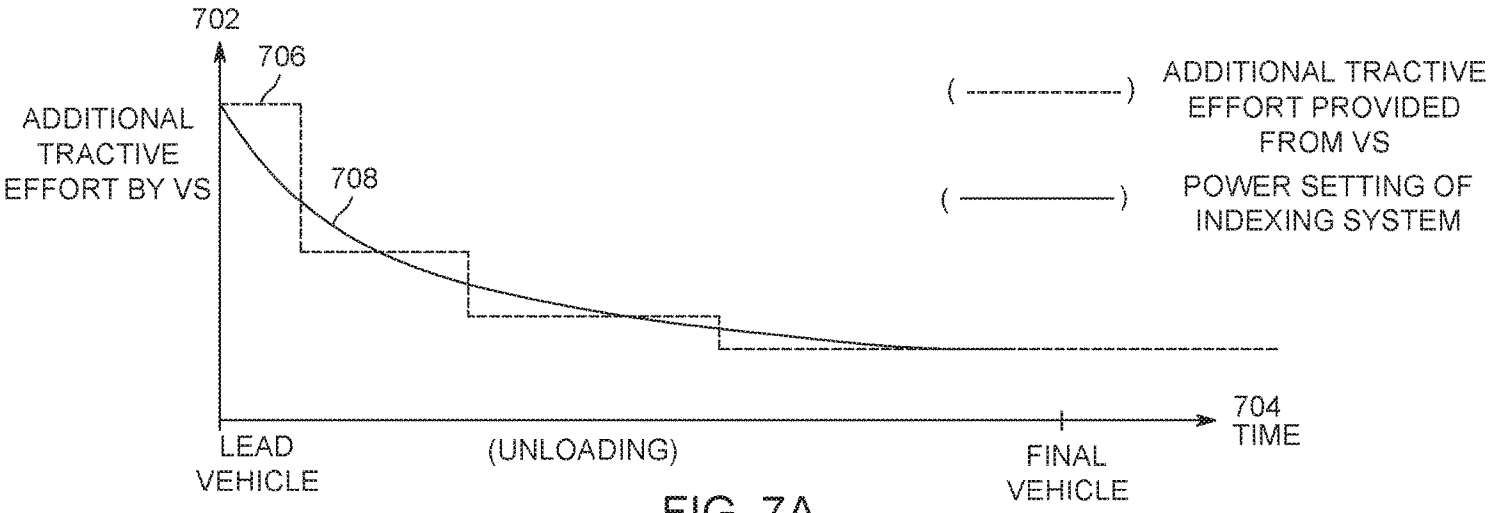
FIG. 7A illustrates a schematic illustration of additional tractive effort in accordance with one embodiment.
Figure 7B:
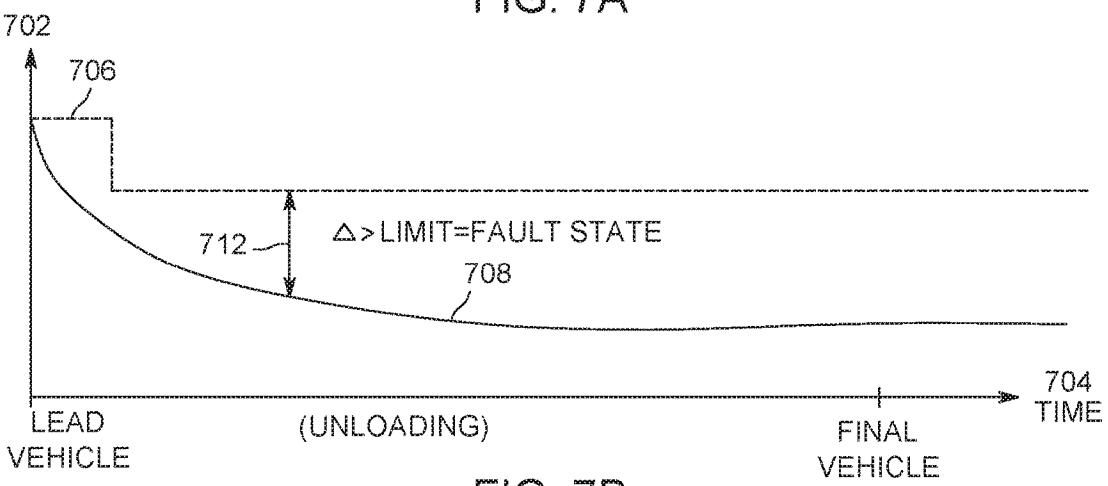
FIG. 7B illustrates a schematic illustration of additional tractive effort exceeding a fault state predetermined threshold margin in accordance with one embodiment.
Figure 7C:
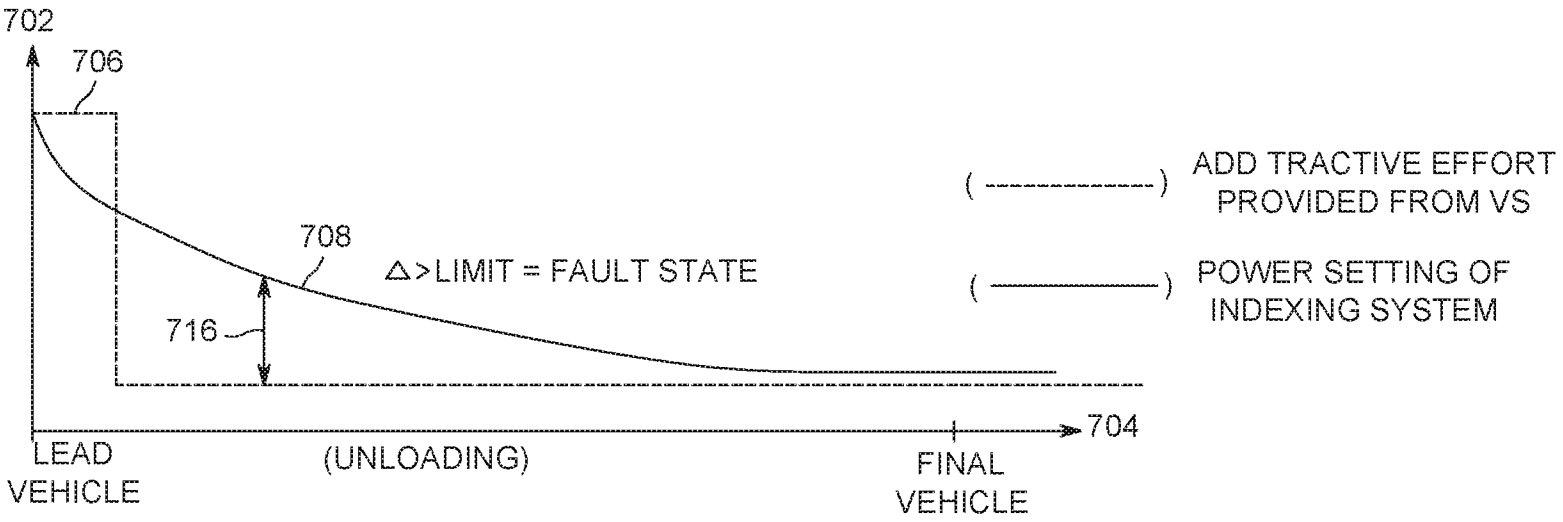
FIG. 7C illustrates a schematic illustration of additional tractive effort less than a fault state predetermined threshold margin in accordance with one embodiment.

FIGS. 7A, 7B, and 7C illustrate three examples of the vehicle indexing system 104 indexing vehicles 106 into the indexing position 110 to unload cargo carried by the vehicles 106. FIG. 7A illustrates an example of the vehicle indexing system 104 indexing vehicles 106 with the additional tractive effort provided by the vehicle system 108 in order to index the vehicles 106 to unload cargo carried by the vehicles 106. Shown as a function of power 702 versus time 704, the graph illustrates the power setting 708 of the vehicle indexing system 104 and the additional tractive effort of the vehicle power settings 706 of the vehicle system 108. The throttle notch settings power setting 708 and vehicle power setting 706 decrease over time. The power setting 708 curve illustrates the power setting for the vehicle indexing system 104. For example, over time, the power setting 708 of the vehicle indexing system 104 decreases as cargo is unloaded and the weight of the vehicle system 108 decreases. As the weight of the vehicle system 108 decreases, the vehicle indexing system 104 requires less power to index the vehicles 106 into the indexing position 110. Additionally, over time, the vehicle power setting 706 of the vehicle system 108 decreases as cargo is unloaded. As the weight of the vehicle system 108 decreases, the vehicle system 108 requires less power to assist the vehicle indexing system 104 to index the vehicles 106 into the indexing position 110.

FIG. 7B illustrates an example of the additional tractive effort by the vehicle system 108 exceeding a fault state predetermined threshold margin by a difference 712. The power setting 708 curve illustrates the power setting for the vehicle indexing system 104. Over time, the power setting 708 of the vehicle indexing system 104 decreases as cargo is unloaded. However, over time, as illustrated in FIG. 7B, the additional tractive effort of the vehicle power setting 706 does not continue to decrease as cargo is unloaded from the vehicle system 108. The difference 712 between the power setting 708 and the vehicle power setting 706 identifies a fault state when the additional tractive effort by the vehicle system 108 exceeds the predetermined threshold margin. For example, FIG. 7B illustrates an example when the EMS 216 may identify that the tractive effort is outside of the predetermined threshold margin and that a responsive action is required. For example, as the cargo is unloaded from the vehicles 106, the vehicle power setting 706 fails to decrease over time due to a cargo load heavier than anticipated. The heavier cargo load requires a greater additional tractive effort than anticipated.

FIG. 7C illustrates an example of the additional tractive effort by the vehicle system 108 less than the fault state predetermined threshold margin by a difference 716. The power setting 708 curve illustrates the power setting for the vehicle indexing system 104. Over time, the power setting 708 of the vehicle indexing system 104 decreases as cargo is unloaded. However, over time, as illustrated in FIG. 7C, the vehicle power setting 706 does not gradually decrease as cargo is unloaded from the vehicle system 108. The difference 716 between the power setting 708 and the vehicle power setting 706 identifies a fault state when the additional tractive effort by the vehicle system 108 is less than the predetermined threshold margin. For example, FIG. 7C illustrates an example when the EMS 216 may identify that the tractive effort is outside of the predetermined threshold margin and that a responsive action is required. For example, as the cargo is unloaded from the vehicles 106, the vehicle power setting 706 decreases sharply due to a cargo load lighter than anticipated. The lighter cargo load requires a lesser additional tractive effort than anticipated.

Figure 8A:
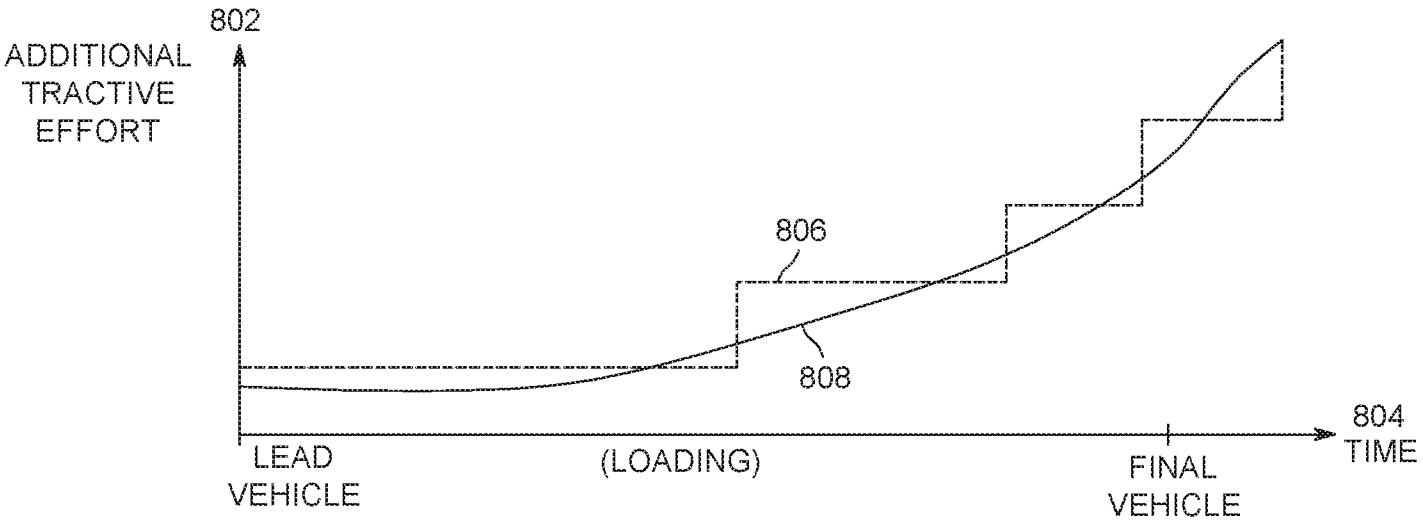
FIG. 8A illustrates a schematic illustration of additional tractive effort in accordance with one embodiment.
Figure 8B:
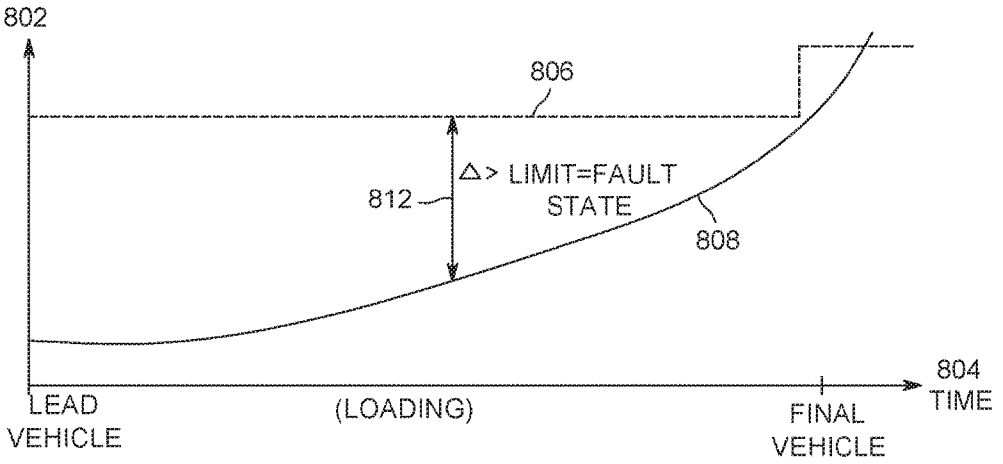
FIG. 8B illustrates a schematic illustration of additional tractive effort exceeding a fault state predetermined threshold margin in accordance with one embodiment.
Figure 8C:
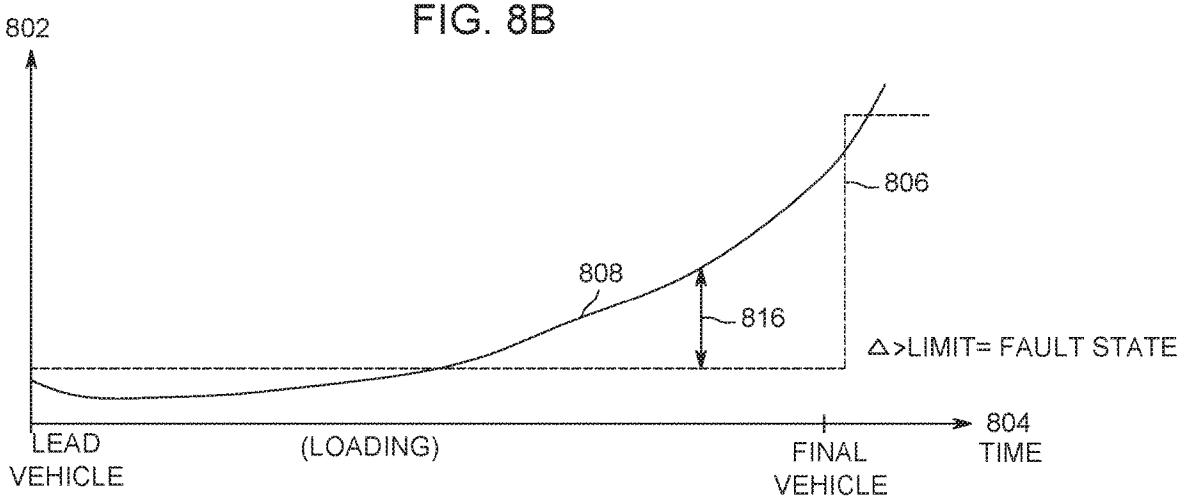
FIG. 8C illustrates a schematic illustration of additional tractive effort less than a fault state predetermined threshold margin in accordance with one embodiment.

FIGS. 8A, 8B, and 8C illustrate three examples of the vehicle indexing system 104 indexing vehicles 106 into the indexing position 110 to load cargo carried by the vehicles 106. FIG. 8A illustrates an example of the vehicle indexing system 104 indexing vehicles 106 with the additional tractive effort provided by the vehicle system 108 in order to index the vehicles 106 to load cargo carried by the vehicles 106. Shown as a function of power 802 versus time 804, the graph illustrates the power setting 808 of the vehicle indexing system 104 and the additional tractive effort of the vehicle power settings 806 of the vehicle system 108. The throttle notch power setting 708 and vehicle power setting 706 increase over time. The power setting 808 curve illustrates the power setting for the vehicle indexing system 104. For example, over time, the power setting 808 of the vehicle indexing system 104 increases as cargo is loaded into the vehicles 106 and the weight of the vehicle system 108 increases. As the weight of the vehicle system 108 increases, the vehicle indexing system 104 requires more power to index the vehicles 106 into the indexing position 110. Additionally, over time, the vehicle power setting 806 of the vehicle system 108 increases as cargo is loaded. As the weight of the vehicle system 108 increases, the vehicle system 108 requires more power to assist the vehicle indexing system 104 to index the vehicles 106 into the indexing position 110.

FIG. 8B illustrates an example of the additional tractive effort by the vehicle system 108 exceeding the fault state predetermined threshold margin by a difference 812. The power setting 808 curve illustrates the power setting for the vehicle indexing system 104. Over time, the power setting 808 of the vehicle indexing system 104 gradually increases as cargo is loaded into the vehicles 106 of the vehicle system 108. However, over time, as illustrated in FIG. 8B, the vehicle power setting 806 does not gradually increase as cargo is loaded into the vehicles of the vehicle system 108. The difference 812 between the power setting 808 and the vehicle power setting 806 identifies a fault state when the additional tractive effort by the vehicle system 108 exceeds the predetermined threshold margin. For example, FIG. 8B illustrates an example when the EMS 216 may identify that the tractive effort is outside of the predetermined threshold margin and that a responsive action is required. For example, as the cargo is loaded into the vehicles 106, the vehicle power setting 806 is greater than anticipated due to a cargo load heavier than anticipated. The heavier cargo load requires a greater additional tractive effort than anticipated.

FIG. 8C illustrates an example of the additional tractive effort by the vehicle system 108 less than the fault state predetermined threshold margin by a difference 816. The power setting 808 curve illustrates the power setting for the vehicle indexing system 104. Over time, the power setting 808 of the vehicle indexing system 104 increases as cargo is loaded into the vehicles 106 of the vehicle system 108. However, over time, as illustrated in FIG. 8C, the vehicle power setting 806 does not gradually increase as cargo is loaded into the vehicle system 108. The difference 816 between the power setting 808 and the vehicle power setting 806 identifies a fault state when the additional tractive effort by the vehicle system 108 is less than the predetermined threshold margin. For example, FIG. 8C illustrates an example when the EMS 216 may identify that the tractive effort is outside of the predetermined threshold margin and that a responsive action is required. For example, as the cargo is loaded into the vehicles 106, the vehicle power setting 806 does not increase over time as anticipated due to a cargo load lighter than anticipated. The lighter cargo load requires a lesser additional tractive effort than anticipated.

In one embodiment of the subject matter described herein, a control system is provided that includes a controller configured to operate a vehicle indexing system that moves one or more vehicles in a vehicle system into a position to one or more of unload cargo off of the one or more vehicles or load the cargo onto the one or more vehicles. The controller is configured to determine a power setting of the vehicle indexing system that is used by the vehicle indexing system to move the one or more vehicles in the vehicle system into the position. The controller also is configured to determine a vehicle power setting for the vehicle system based on the power setting of the vehicle indexing system for controlling the vehicle system to provide additional tractive effort to the vehicle indexing system to move the one or more vehicles into the position.

Optionally, the controller is configured to be located off-board the vehicle system. The controller is configured to communicate the vehicle power setting to a remote control device disposed off-board the vehicle system for remotely controlling the vehicle system according to the vehicle power setting. The vehicle power setting includes a throttle notch setting. The controller is configured to determine the vehicle power setting for the vehicle system to move a second vehicle of the vehicle system into the position after a lead vehicle is moved into the position, wherein moving the second vehicle into the position moves the lead vehicle out of the position.

Optionally, the controller is configured to determine the vehicle power setting based on a tractive effort previously generated by the vehicle indexing system to move at least one of the vehicles in the vehicle system into the position. The controller is configured to communicate the vehicle power setting to an on-board control unit on-board the vehicle system for controlling the vehicle system according to the vehicle power setting Optionally, the controller is configured to determine a tractive effort generated by the vehicle system to move at least a first vehicle of the vehicles in the vehicle system into the position, the controller also configured to determine a fault state of one or more of a braking system or a route traveled by the vehicle system based on the tractive effort. The controller is configured to move the one or more vehicles into the position for the one or more of unloading the cargo or loading the cargo without the vehicle system being separated into two or more smaller segments of the vehicle In one embodiment of the subject matter described herein, a method comprises determining a power setting of the vehicle indexing system that is used to move one or more vehicles in a vehicle system into a position to one or more of unload cargo off of the one or more vehicles or load the cargo onto the one or more vehicles. And determining a vehicle power setting for the vehicle system based on the power setting of the vehicle indexing system for controlling the vehicle system to provide additional tractive effort to move the one or more vehicles into the position to one or more of unload cargo off of the one or more vehicles or load the cargo onto the one or more vehicles.

Optionally, the method comprises wherein determining occurs off-board the vehicle system. Further comprising communicating the vehicle power setting to a remote control device disposed off-board the vehicle system for remotely controlling the vehicle system according to the vehicle power setting. The method comprises wherein the vehicle power setting includes a throttle notch setting.

Optionally, the vehicle power setting is determined to control the vehicle system to move a second vehicle of the vehicle system into the position after a lead vehicle is moved into the position, and move the second vehicle into the position moves the lead vehicle out of the position. The vehicle power setting is determined based on a tractive effort previously generated by the vehicle indexing system to move at least one of the vehicles in the vehicle system into the position.

Optionally, the method further comprises communicating the vehicle power setting to an on-board control unit on-board the vehicle system for remotely controlling the vehicle system according to the vehicle power setting. The method further comprising determining a tractive effort generated by the vehicle system to move at least a first vehicle of the vehicles in the vehicle system into the position, the controller also configured to determine a fault state of one or more of a braking system or a route traveled by the vehicle system based on the tractive effort. The vehicle power setting is determined to control the vehicle system to move the one or more vehicles into the position for the one or more of unloading the cargo or loading the cargo without the vehicle system being separated into two or more smaller segments of the vehicle system In one embodiment, a control system comprises a controller configured to operate a vehicle indexing system that moves one or more vehicles in a vehicle system into a position to one or more of unload cargo off of the one or more vehicles or load the cargo onto the one or more vehicles. The controller configured to determine a power setting of the vehicle indexing system that is used by the vehicle indexing system to move the one or more vehicles in the vehicle system into the position. Wherein the controller also is configured to determine a vehicle power setting for the vehicle system based on the power setting of the vehicle indexing system for controlling the vehicle system to provide additional tractive effort to the vehicle indexing system to move the one or more vehicles into the position. And wherein the controller also is configured to determine a fault state of one or more of a braking system or a route traveled by the vehicle system based on the tractive effort.

Optionally, the controller is configured to alert the vehicle system when the fault state exceeds a designated threshold margin.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the disclosed subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second,", and "third," etc. are used merely as labels, and are not intended to impose numerical requirements on their objects. Further, the limitations of the following claims are not written in means-plus-function format and are not intended to be interpreted based on 35 U.S.C. 112(f), unless and until such claim limitations expressly use the phrase "means for" followed by a statement of function void of further structure.

This written description uses examples to disclose several embodiments of the inventive subject matter, including the best mode, and also to enable a person of ordinary skill in the art to practice the embodiments of inventive subject matter, including making and using any devices or systems and performing any incorporated methods. The patentable scope of the inventive subject matter is defined by the claims, and may include other examples that occur to a person of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, communication unit, control system, etc) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element of a plurality of elements having a particular property may include additional such elements not having that property.

Since certain changes may be made in the above-described systems and methods, without departing from the spirit and scope of the inventive subject matter herein involved, it is intended that all of the subject matter of the above description or shown in the accompanying drawings shall be interpreted merely as examples illustrating the inventive concept herein and shall not be construed as limiting the inventive subject matter.

What is claimed is:

1. A control system comprising, a controller configured to operate a vehicle indexing system that moves one or more vehicles in a vehicle system into a position to one or more of unload cargo off of the one or more vehicles or load the cargo onto the one or more vehicles, the controller configured to determine a power setting of the vehicle indexing system that is used by the vehicle indexing system to move the one or more vehicles in the vehicle system into the position, wherein the controller also is configured to determine a vehicle power setting for the vehicle system based on the power setting of the vehicle indexing system for controlling the vehicle system to provide additional tractive effort to the vehicle indexing system to move the one or more vehicles into the position.

2. The control system of claim 1, wherein the controller is configured to be located off-board the vehicle system.

3. The control system of claim 1, wherein the controller is configured to communicate the vehicle power setting to a remote control device disposed off-board the vehicle system for remotely controlling the vehicle system according to the vehicle power setting.

4. The control system of claim 1, wherein the vehicle power setting includes a throttle notch setting.

5. The control system of claim 1, wherein the controller is configured to determine the vehicle power setting for the vehicle system to move a second vehicle of the vehicle system into the position after a lead vehicle is moved into the position, wherein moving the second vehicle into the position moves the lead vehicle out of the position.

6. The control system of claim 1, wherein the controller is configured to determine the vehicle power setting based on a tractive effort previously generated by the vehicle indexing system to move at least one of the vehicles in the vehicle system into the position.

7. The control system of claim 1, wherein the controller is configured to communicate the vehicle power setting to an on-board control unit on-board the vehicle system for controlling the vehicle system according to the vehicle power setting.

8. The control system of claim 1, wherein the controller is configured to determine a tractive effort generated by the vehicle system to move at least a first vehicle of the vehicles in the vehicle system into the position, the controller also configured to determine a fault state of one or more of a braking system or a route traveled by the vehicle system based on the tractive effort.

9. The control system of claim 1, wherein the controller is configured to move the one or more vehicles into the position for the one or more of unloading the cargo or loading the cargo without the vehicle system being separated into two or more smaller segments of the vehicle system.

10. A method comprising, determining a power setting of a vehicle indexing system that is used to move one or more vehicles in a vehicle system into a position to one or more of unload cargo off of the one or more vehicles or load the cargo onto the one or more vehicles; and determining a vehicle power setting for the vehicle system based on the power setting of the vehicle indexing system for controlling the vehicle system to provide additional tractive effort to move the one or more vehicles into the position to one or more of unload cargo off of the one or more vehicles or load the cargo onto the one or more vehicles.

11. The method of claim 10, wherein determining the vehicle power setting occurs off-board the vehicle system.

12. The method of claim 10, further comprising communicating the vehicle power setting to a remote control device disposed off-board the vehicle system for remotely controlling the vehicle system according to the vehicle power setting.

13. The method of claim 10, wherein the vehicle power setting includes a throttle notch setting.

14. The method of claim 10, wherein the vehicle power setting is determined to control the vehicle system to move a second vehicle of the vehicle system into the position after a lead vehicle is moved into the position, and move the second vehicle into the position moves the lead vehicle out of the position.

15. The method of claim 10, wherein the vehicle power setting is determined based on a tractive effort previously generated by the vehicle indexing system to move at least one of the vehicles in the vehicle system into the position.

16. The method of claim 10, further comprising communicating the vehicle power setting to an on-board control unit on-board the vehicle system for remotely controlling the vehicle system according to the vehicle power setting.

17. The method of claim 10, further comprising determining a tractive effort generated by the vehicle system to move at least a first vehicle of the vehicles in the vehicle system into the position, the controller also configured to determine a fault state of one or more of a braking system or a route traveled by the vehicle system based on the tractive effort.

18. The method of claim 10, wherein the vehicle power setting is determined to control the vehicle system to move the one or more vehicles into the position for the one or more of unloading the cargo or loading the cargo without the vehicle system being separated into two or more smaller segments of the vehicle system.

19. The method of claim 10, further comprising determining a second vehicle power setting for the vehicle system to provide a full tractive effort to move the one or more vehicles of the vehicle system into the position without the use of the vehicle indexing system, responsive to when the vehicle indexing system is unavailable.

20. A control system comprising, a controller configured to operate a vehicle indexing system that moves one or more vehicles in a vehicle system into a position to one or more of unload cargo off of the one or more vehicles or load the cargo onto the one or more vehicles, the controller configured to determine a power setting of the vehicle indexing system that is used by the vehicle indexing system to move the one or more vehicles in the vehicle system into the position, wherein the controller also is configured to determine a vehicle power setting for the vehicle system based on the power setting of the vehicle indexing system for controlling the vehicle system to provide additional tractive effort to the vehicle indexing system to move the one or more vehicles into the position; and wherein the controller also is configured to determine a fault state of one or more of a braking system or a route traveled by the vehicle system based on the tractive effort.

21. The control system of claim 20, wherein the controller is configured to alert the vehicle system when the fault state exceeds a designated threshold margin.

* * * * *